US010583456B2

(12) United States Patent
Bedeschi et al.

(10) Patent No.: US 10,583,456 B2
(45) Date of Patent: Mar. 10, 2020

(54) METHOD AND APPARATUS FOR APPLYING PAINT ON BASICALLY FLAT PARTS

(71) Applicant: CEFLA SOCIETA' COOPERATIVA, Imola (IT)

(72) Inventors: Riccardo Bedeschi, Lugo (IT); Andrea Luca Guiduzzi, Massa Lombarda (IT); Stefano Chiarini, Conselice (IT)

( * ) Notice: Subject to any disclaimer, the term of this patent is extended or adjusted under 35 U.S.C. 154(b) by 271 days.

(21) Appl. No.: 14/255,767

(22) Filed: Apr. 17, 2014

(65) Prior Publication Data

US 2014/0311406 A1 Oct. 23, 2014

(30) Foreign Application Priority Data

Apr. 22, 2013 (IT) ..... BO2013A0182

(51) Int. Cl.

| | |
|---|---|
| ***B05D 1/02*** | (2006.01) |
| ***B05B 13/02*** | (2006.01) |
| ***B05B 16/60*** | (2018.01) |
| ***B05B 16/40*** | (2018.01) |
| ***B05B 16/00*** | (2018.01) |

(52) U.S. Cl.

CPC ..... *B05D 1/02* (2013.01); *B05B 13/0221* (2013.01); *B05B 16/00* (2018.02); *B05B 16/405* (2018.02); *B05B 16/60* (2018.02); *B05B 16/95* (2018.02)

(58) Field of Classification Search

CPC ..... B05B 15/12–1296; B05B 13/0221; B05B 16/00–95; B05C 15/00

See application file for complete search history.

(56) References Cited

U.S. PATENT DOCUMENTS

| | | | | | |
|---|---|---|---|---|---|
| 4,245,551 | A | * | 1/1981 | Berkmann | B05B 15/1229 118/326 |
| 4,567,818 | A | * | 2/1986 | Napadow | B05B 15/1277 118/326 |
| 4,953,495 | A | * | 9/1990 | Salisbury | B05B 5/082 118/308 |
| 5,107,789 | A | * | 4/1992 | Salisbury | B05B 5/082 118/305 |
| 5,153,034 | A | | 10/1992 | Telchuk et al. | |
| 5,259,879 | A | * | 11/1993 | Khattab | B05B 16/40 118/309 |
| 5,690,995 | A | * | 11/1997 | Fischli | B05B 7/1454 118/309 |

(Continued)

FOREIGN PATENT DOCUMENTS

| | | |
|---|---|---|
| GB | 2087068 | 5/1982 |
| WO | WO0185357 | 11/2001 |

OTHER PUBLICATIONS

Search Report and Written Opinion for Italian Patent Application No. BO20130182; dated Nov. 11, 2013; 6 pages.

*Primary Examiner* — Karl Kurple
*Assistant Examiner* — Stephen A Kitt
(74) *Attorney, Agent, or Firm* — Themis Law

(57) ABSTRACT

Spray booth (21) for applying paint on basically flat parts (22), said spray booth having a plenum (24) and comprising a conveying system (25) for conveying the flat parts (22) to be painted, at least a device (23) for applying paint on said moving parts, and at least a suction system, wherein the plenum (24) of the spray booth has a semi-cylindrical shape, having its axis perpendicular to the direction of the advancing part (22).

10 Claims, 5 Drawing Sheets

(56) References Cited

U.S. PATENT DOCUMENTS

| | | | | |
|---|---|---|---|---|
| 5,755,246 | A * | 5/1998 | Carl | B08B 15/02 134/73 |
| 5,849,053 | A * | 12/1998 | Napadow | B05B 15/1248 55/385.2 |
| 6,240,873 | B1 | 6/2001 | Bertellotti | |
| 2003/0183166 | A1 | 10/2003 | Hasenour | |

* cited by examiner

METHOD AND APPARATUS FOR APPLYING PAINT ON BASICALLY FLAT PARTS

CROSS REFERENCE TO RELATED APPLICATIONS

The present application claims priority to Italian Patent Application No. BO2013A000182 filed Apr. 22, 2013, the contents of which are expressly incorporated herein by reference.

STATEMENT RE: FEDERALLY SPONSORED RESEARCH/DEVELOPMENT

Not Applicable.

BACKGROUND OF THE INVENTION

The present invention relates to the technical field of apparatuses for applying paint on basically flat parts, known on the market as paint spray booths. In particular, the present invention relates to the shape of their plenum, wherein plenum means a ceiling able to distribute an airflow entering into a space.

Spray booths are known that apply spray paint through automatic devices (reciprocators, rotating spraying system, carousel-rotating system, gantry-robots, anthropomorphic robots) on parts to be painted.

Spray paint application entails that not all the paint hits the part to be painted; the paint not hitting flat parts partly hits the conveying system, and partly hovers in the air in the spray booth itself. This last portion of sprayed paint is called overspray, and is partially intercepted by spray booth suction system.

Non-intercepted overspray tends to contaminate spray booth internal walls, gathering on them up to the point of compromising manufacturing quality and leading to an important waste of painted parts. Therefore costly maintenance and cleaning of the spray booth itself become mandatory.

The overspray intercepted by the suction system is channeled towards spray booth filters, thanks to an air flow produced by the suction system itself, too. In this path the overspray is controlled in a more proper way thanks to the emission of an air flow from the plenum.

Examples of the prior art are U.S. Pat. No. 5,153,034 and US 2003/0183166 describing a paint spray booth having a sloping dual plenum, formed by two sloping plenums moving independently.

Another shape known in the prior art is a flat plenum, horizontal and parallel to the part to be painted, as disclosed in WO 0185357.

SUMMARY OF THE INVENTION

The present invention seeks to provide a spray booth with an improved air circulation, controlling as much as possible the overspray. This can be obtained generating an air flow more congruent with the geometry of the whirl produced by the combined effect of spray guns and suction.

This object is achieved with the plenum of the present invention, which has a semi-circular section, generating an air flow perpendicular to its semi-cylindrical surface. The axis of the semi-cylinder is perpendicular to the conveying direction of the part to be painted within the spray booth.

The semi-cylindrical shape is as much as possible similar to the overspray whirl which is generated. The semi cylindrical plenum works so that the central superior plenum portion keeps low the whirl generated by suction system, while the lateral walls of the semi-cylinder are oriented towards the transversal axis of the spray booth along which the whirl develops. In this way, the whirl itself is compressed towards the center of the spray booth.

The advantages of the present invention are due to the improvement in the control of overspray flow. This has several consequences:

- cleaner painting process, which, for the final user, translates into a lower number of wasted painted parts;
- lower need of cleaning and maintenance of the spray booth;
- lower air consumption to get overspray control (lower number of air renewals per time unit);
- recovery of a higher paint quantity by suction system in the cases where paint can be re-used.

BRIEF DESCRIPTION OF THE DRAWINGS

Further advantages and features of the present invention are disclosed in the following description, in which exemplary embodiments of the present invention are explained in detail on the basis of the enclosed drawings, showing.

DETAILED DESCRIPTION OF THE INVENTION

Figure 1A:
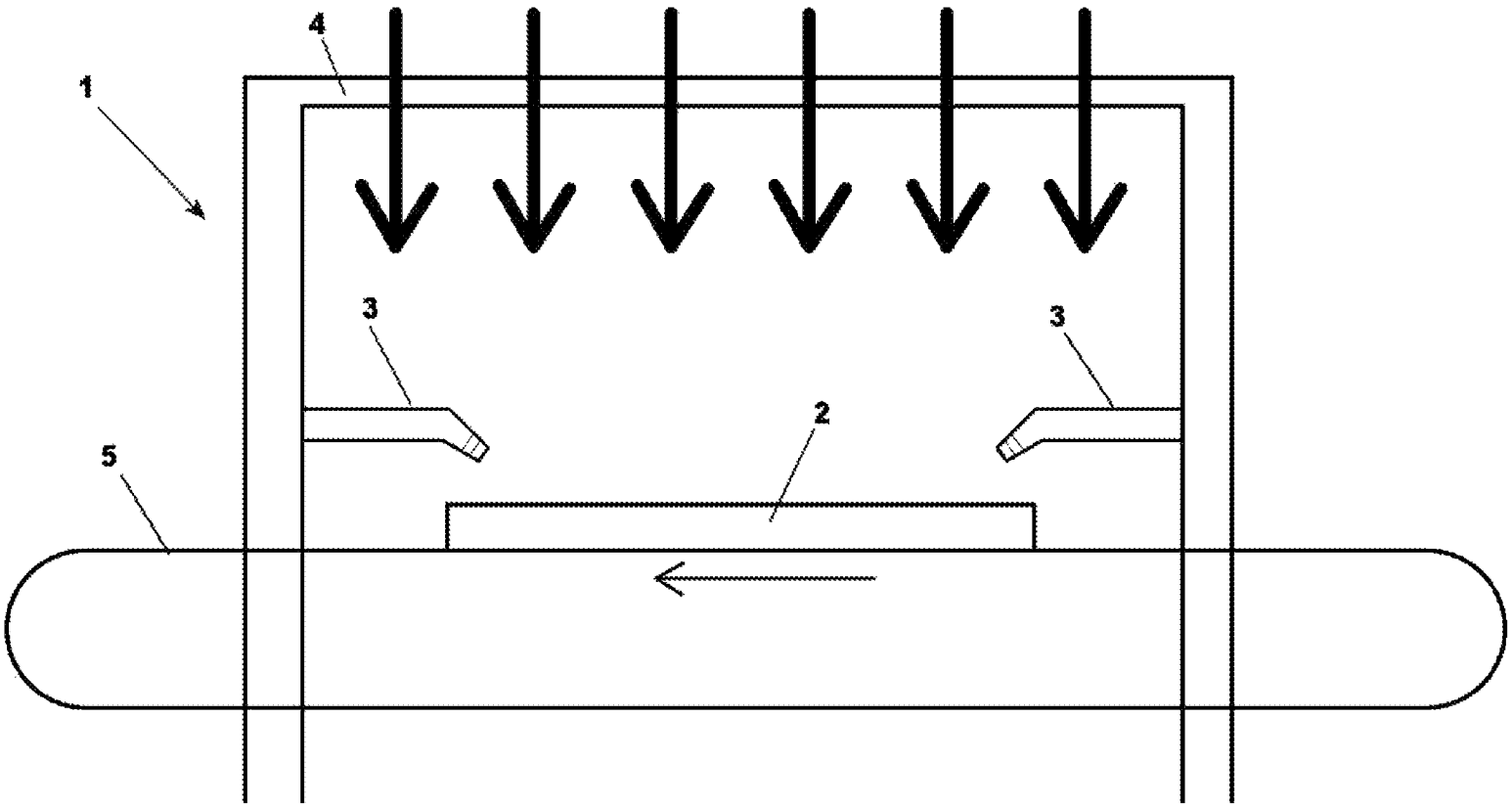
PRIOR ART FIG. 1a
FIGS. 1*a* and 1*b* is a view of a longitudinal section of two prior art examples having flat and sloping plenums, respectively.
Figure 1B:
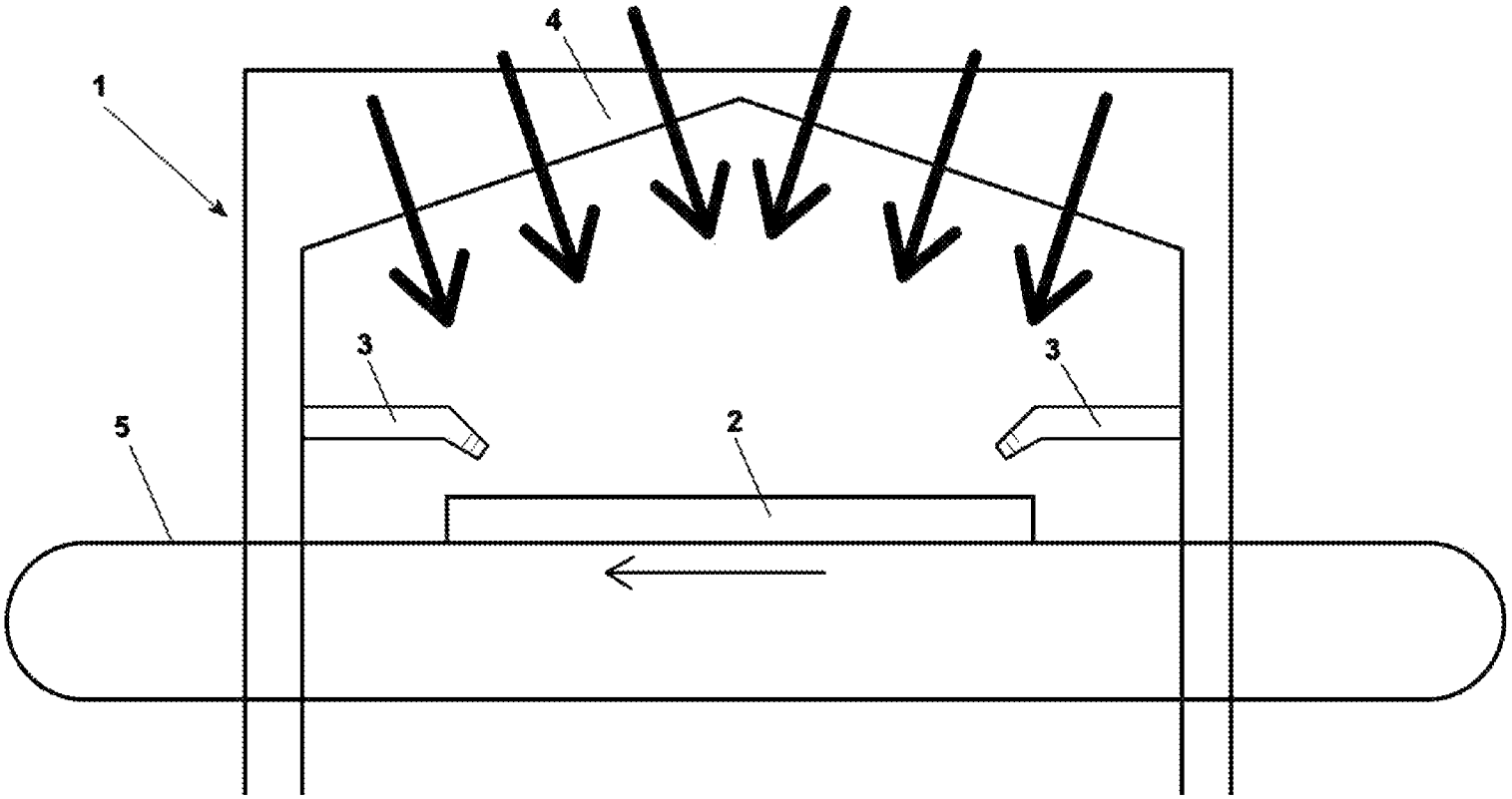
PRIOR ART FIG. 1b

FIGS. 1*a* and 1*b* show on the whole a prior art spray booth 1, wherein a flat part 2 moves forward carried by conveying system 5; the thin arrow shows its direction. The flat part 2 is painted by spray guns 3. FIG. 1*a* shows a spray booth having a flat plenum 4, while FIG. 1*b* shows a spray booth having a sloping dual plenum 4. In both cases the bold arrows show the air flow coming from its plenum, respectively.

Figure 2:
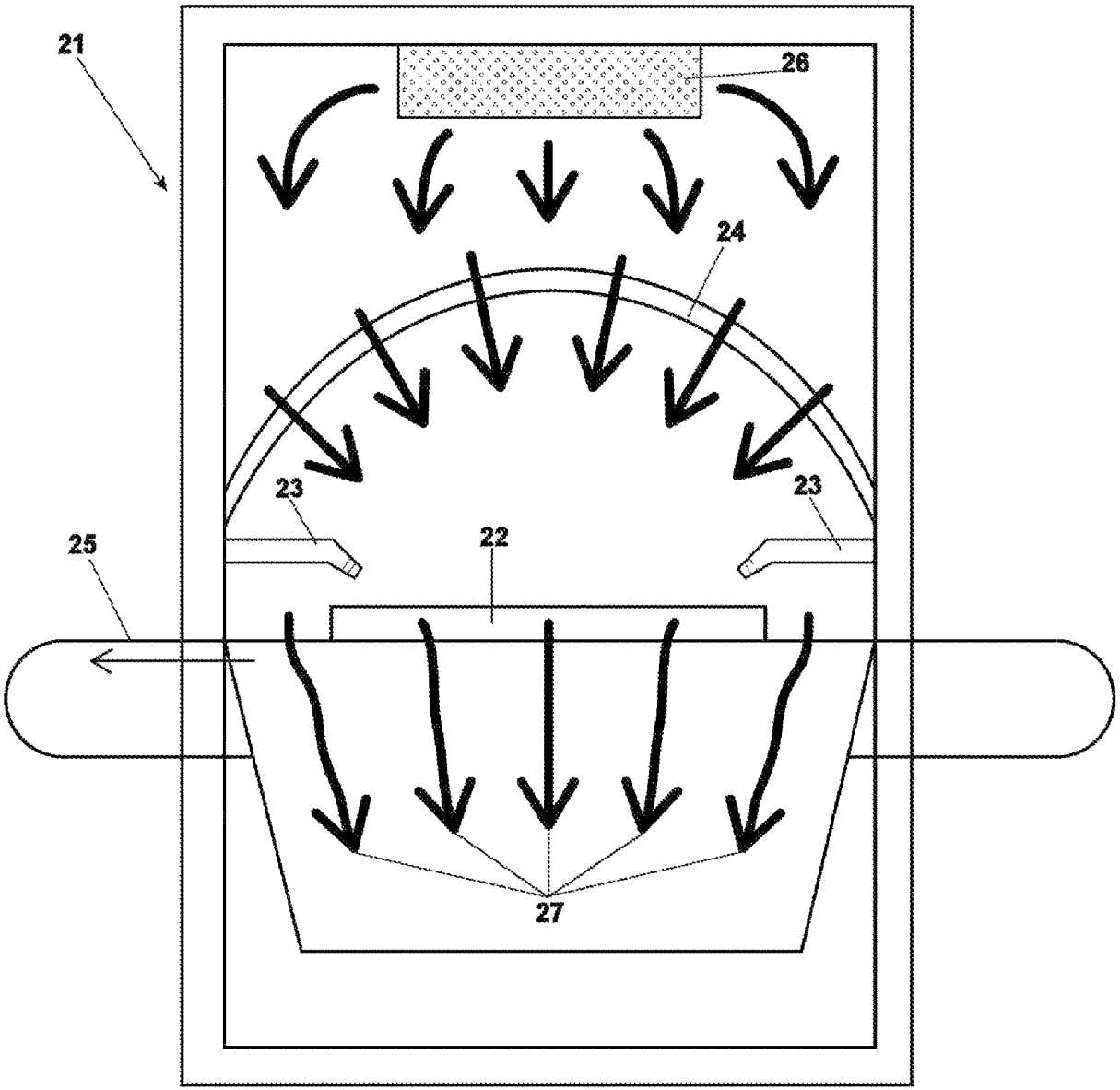
FIG. 2 is a view of a longitudinal section of the present invention on the whole.

FIG. 2 shows a section of the spray booth 21 of the present invention along its longitudinal axis. The spray guns 23 spray paint on flat part 22 moving forward in the sense indicated by the thin arrow. The semi-cylindrical plenum 24 generates an air flow perpendicular to its semi-cylindrical surface, as shown by bold arrows. A diffuser 26 uniformly distributes air in an orderly way within spray booth 21; the diffuser 26 is upstream the semi-cylindrical plenum 24. The arrows 27 show the path of the overspray intercepted by suction and filtering system.

Upstream diffuser 26 there is optionally provided a device (not shown) for forcing air into spray booth 21, e.g. a fan or an independent device external to the spray booth itself.

Figure 3:
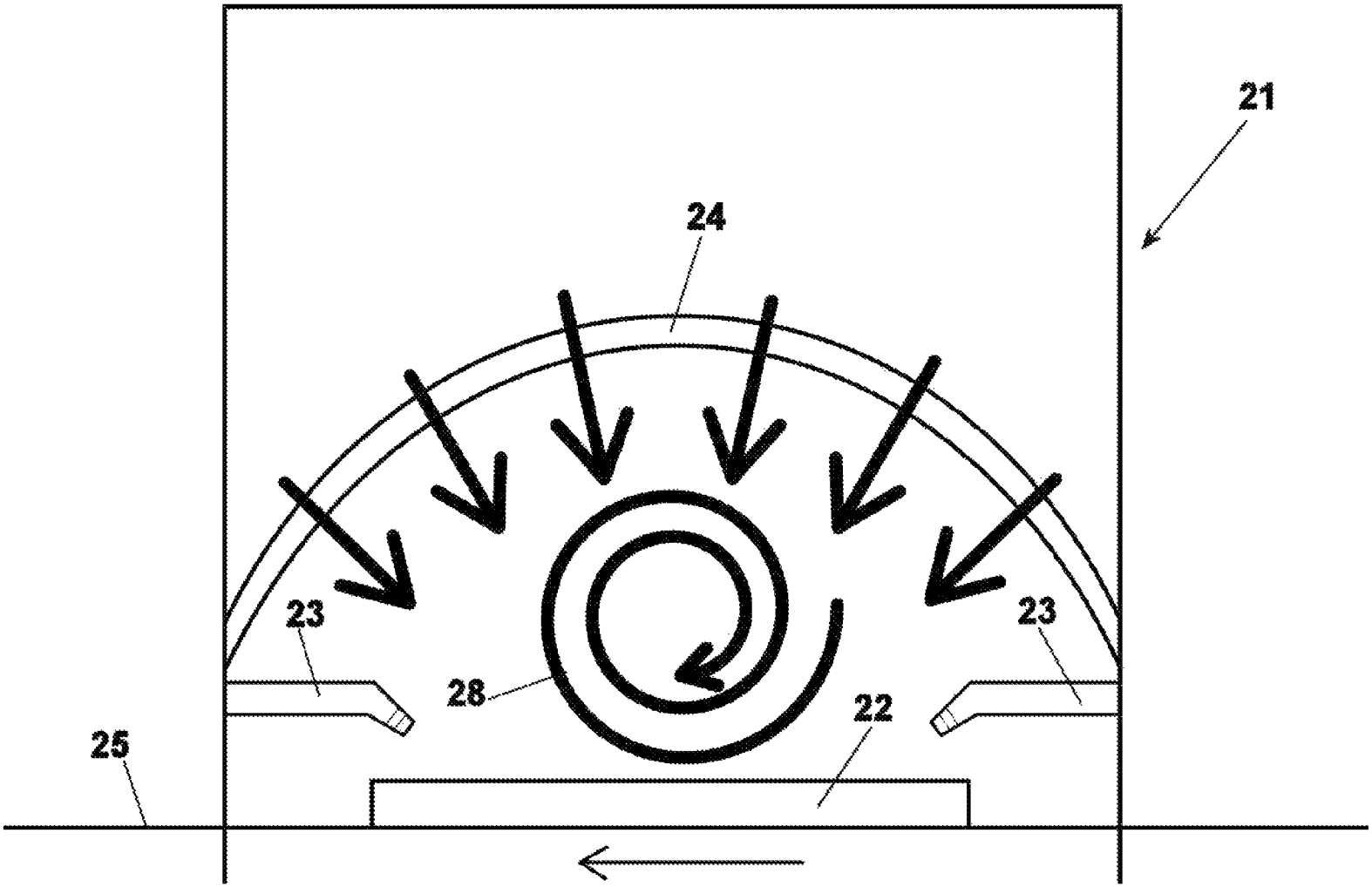
FIG. 3 is a view of a detail of a longitudinal section showing the air flow generated in the present invention.

FIG. 3 shows a detail of an overspray whirl 28 generated in spray booth 21. The semi-cylindrical shape of plenum 24 allows to have a whirl 28 much easier controllable with respect to what occurs in the prior art spray booth, especially those having flat plenums.

Figure 4:
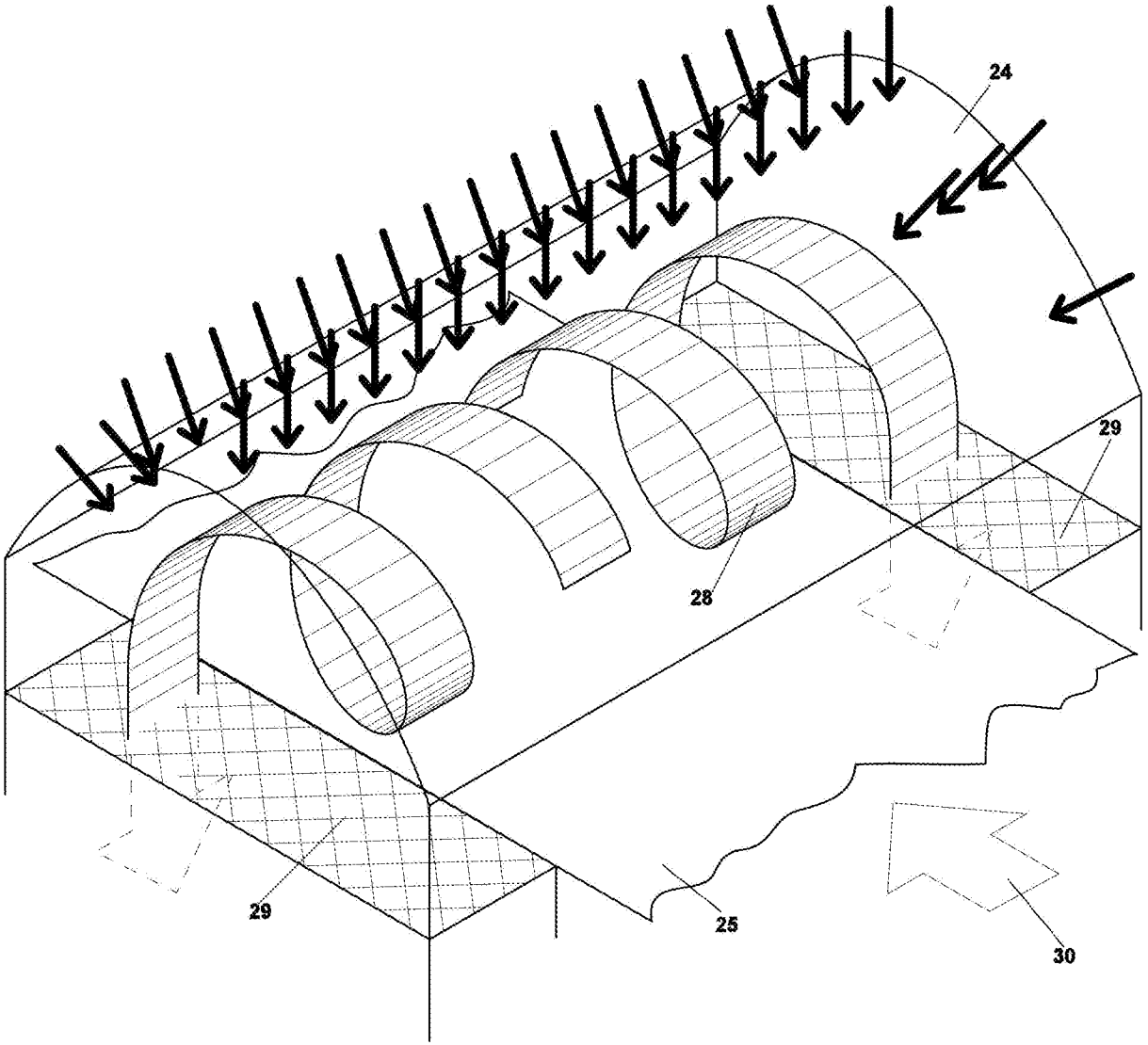
FIG. 4 is an axonometric view of the air flow generated in the spray booth of the present invention.

FIG. 4 shows an axonometric view of spray booth 21, wherein the top part of spray booth is not shown, for better clarity. White arrow 30 shows the direction of the advancing flat part, while whirling flow indicated as arrow 28 is indicatively shown, up to air inlet 29 on both sides of the conveying system 25. In fact a whirling flow 28 develops, having shape and dimensions similar to those of the semi-cylindrical plenum 24, and an axis perpendicular to the conveying direction 30 of parts 2. The black bold arrows show the path of the air flow controlled by diffuser 26.

When spray booth 21 is installed at the final user's premises, usually its parameters must be adjusted for painting process optimization. On one side the plenum geometry is essential, but according to the dimensions of the spray booth, the devices for applying paint, and especially the kind of paint, the air flow is to be adjusted in different ways.

As shown in in-house comparative tests, with the semi cylindrical plenum of the present invention the optimization of the parameters of spray booth 21 was surprisingly simpler and faster compared to the spray booth having different plenum.

Another advantage of the present invention is linked to suction system filter change. As a matter of fact, when filters are dirty, up to their removal the overspray control progressively deteriorates, and returns to optimal level when filters are changed. With the semi-cylindrical plenum of the present invention, the overspray control is much less sensitive to dirty accumulation on filters, leading to a steadier quality of the process.

What is claimed is:

1. A spray booth for applying paint on basically flat moving parts, said spray booth having a plenum and comprising:

a conveying system adapted to convey the moving parts to be painted;

at least one device adapted to apply paint on said moving parts; and at least one suction system, wherein a top of the plenum of the spray booth is defined by a cover consisting of a continuous arcuate wall disposed over the conveying system, the cover having its longitudinal axis perpendicular to a direction of travel of the moving parts on the conveying system, wherein the conveying system extends longitudinally along a bottom of the spray booth to carry the moving parts under the plenum, and wherein the plenum is configured to enable a flow therethrough of air into the spray booth, the continuous arcuate wall causing the air to generate a whirl within the spray booth under the plenum and the paint to be applied on the moving parts to be captured in the whirl, thereby limiting overspray dispersion.

2. The spray booth according to claim 1, wherein a direction of air flow is perpendicular to an inner surface of the arcuate wall.

3. The spray booth according to claim 2, wherein at least one diffuser uniformly distributes air in a volume upstream of the arcuate wall.

4. The spray booth according to claim 1, further comprising at least one device adapted to force the air into the spray booth.

5. The spray booth according to claim 1, wherein the conveying system is a belt conveying system.

6. The spray booth according to claim 1, wherein the suction system comprises dry filters.

7. The spray booth according to claim 6, wherein the suction system comprises waterfall filters.

8. The spray booth according to claim 1, wherein the device for applying paint is chosen from the group consisting of reciprocators, rotating system, carousel-rotating system, gantry robots, and anthropomorphic robots.

9. A spray booth for applying paint on basically flat moving parts, said spray booth having a plenum and comprising:

a conveying system adapted to convey the moving parts to be painted;

at least one device adapted to apply paint on said moving parts; and at least one suction system, wherein a top of the plenum of the spray booth is defined by a cover extending over the conveying system and consisting of a continuous arcuate wall permeable to air, the cover defining a ceiling of a tunnel, a bottom wall of the tunnel being formed at least in part by the conveying system, the plenum defining a rectangular footprint and a curve of the arcuate wall extending from a first side of a rectangle to a second, opposite side of the rectangle corresponding to two straight edges of a perimeter of the arcuate wall, the arcuate wall further having its longitudinal axis parallel to an axis of the tunnel and perpendicular to a direction of travel of the moving parts on the conveying system, wherein the conveying system extends longitudinally along a bottom of the spray booth to carry the moving parts under the plenum, and wherein a flow of the air enters into the spray booth through the plenum, the continuous arcuate wall causing the air to move in whirling motion within the spray booth under the plenum and the paint to be applied on the moving parts to be captured in the whirl, thereby limiting overspray dispersion.

10. The spray booth according to claim 1, wherein the suction system comprises air inlets defined at opposing lateral ends of the conveying system, the air inlets receiving the air moving with whirling motion in the spray booth.

* * * * *